US005839374A

United States Patent [19]

Conner et al.

[11] Patent Number: 5,839,374

[45] Date of Patent: Nov. 24, 1998

[54] BLOWER FOR GENERATING STATIC PRESSURE

[75] Inventors: Michael P. Conner, Uniontown; Randy A. Colage, Stow, both of Ohio

[73] Assignee: Ametek, Inc., Kent, Ohio

[21] Appl. No.: 827,553

[22] Filed: Mar. 28, 1997

[51] Int. Cl.[6] ..... F23L 17/00

[52] U.S. Cl. ..... 110/162; 415/118; 415/223

[58] Field of Search ..... 431/20; 110/162; 126/116 A, 116 R, 110 R; 415/118, 17, 119, 223

[56] References Cited

U.S. PATENT DOCUMENTS

| | | | |
|---|---|---|---|
| 3,390,545 | 7/1968 | Hoffman . | |
| 4,460,329 | 7/1984 | Trent | 431/20 |
| 4,470,753 | 9/1984 | Witzel | 415/119 X |
| 5,040,943 | 8/1991 | Dwyer et al. | 415/119 X |
| 5,171,128 | 12/1992 | Williamson et al. . | |
| 5,586,861 | 12/1996 | Berger | 415/118 |

*Primary Examiner*—Henry A. Bennett
*Assistant Examiner*—Susanne C. Tinker
*Attorney, Agent, or Firm*—Renner, Kenner, Greive, Bobak, Taylor & Weber

[57] ABSTRACT

A blower fan assembly for removing combusted by-products and flue gas from a furnace is presented. The blower fan assembly includes a housing with a cavity for receiving a blower fan. The housing is secured over an opening in a furnace so that when the blower fan rotates, flue gas is drawn from the furnace to an exhaust conduit outside the building in which the furnace is received. The blower fan includes a fan ring connected to a fan disc by a plurality of vanes which are parallel with the axis of rotation. A motor, mounted to the housing, rotates the fan disc. The blower fan draws air in through the fan ring, through the plurality of vanes and out through the exhaust conduit. A static pressure tap is located in the housing and is connected to a pressure sensor which measures the static pressure generated by the blower fan as it rotates. By employing a plurality of pressure openings in the fan disc, a predictable range of static pressures can be generated within the cavity which allows the pressure sensor to monitor whether the blower fan assembly is working properly. Thus, if the pressure sensor determines that the blower fan is not working, the furnace is turned off. This precludes generation of flue gas that might accumulate in the building receiving the furnace. By adjusting the number of pressure openings, the blower fan assembly can be designed so that the static pressure tap is in only one location and does not have to be placed in different locations for each particular use of the blower fan assembly with a particular furnace.

13 Claims, 3 Drawing Sheets

BLOWER FOR GENERATING STATIC PRESSURE

TECHNICAL FIELD

The present invention resides in the art of blower assemblies and, more particularly, to a blower assembly adapted for implementation with an induced draft blower for gas furnaces. Specifically, the present invention relates to a blower for generating a static pressure within a blower housing that is readable within a predetermined range of pressure values to ensure that the blower assembly is operating properly.

BACKGROUND ART

High and mid efficiency gas furnaces employ induced draft blowers to maintain a sufficient draft for the requisite combustion within a furnace. Induced draft blowers may be positioned prior to or after heat exchangers to facilitate air flow therethrough. The induced draft blower functions to push heated air through the furnace while expelling residual combustion by-products or flue gas out of the building or house where the furnace is located.

Induced draft blowers include a housing mounted over a hole in a wall or panel surface of the furnace. A blower fan within the housing is rotated by a motor, wherein the blower fan draws the combustion by-products through the furnace for expulsion out an exhaust conduit. These blower fans typically comprise two circular discs interconnected by curved vanes with passages defined therebetween. One of the discs is connected to and rotated by a motor shaft while the other disc has a centrally positioned circular opening that is contiguous with the passages between the vanes. As the blower fan is rotated, flue gas is pulled in through the panel surface opening, through the fan disc circular opening and re-directed outwardly through the passages toward the exhaust conduit.

It is of critical importance that the blower fan always be operational. Otherwise, the harmful combustion by-products are not expelled and they may damage the furnace and enter the building causing injury. One step taken to ensure that no combustion by-products leak from the induced draft blower is to provide no more than three holes in the fan disc adjacent the motor shaft. These holes generate an air draft around the motor shaft causing a negative vacuum thereabout. In other words, the holes in the disc nearest the motor shaft ensure that air is pulled in through where the motor shaft is received by the housing, thus precluding any combustion by-products from escaping at the motor shaft opening. This air is then also forced out the exhaust conduit.

One way to ensure the blower fan is functioning properly is to provide a pressure tap in the induced draft blower. The tap must monitor enough static pressure in the housing to engage a safety switch during normal operating conditions which include, but are not limited to: various venting lengths, wind conditions, and furnace size. Under abnormal conditions, which cause unacceptable combustion by-products, the tap pressure decreases to allow the safety pressure switch to disengage which turns the furnace off.

A static pressure is generated within the housing when the blower fan is rotated. When static pressure enters the pressure tap, the furnace is maintained in on condition as long as a predetermined range of pressure is sustained within the housing. Prior induced draft blowers achieve the required range of pressure by relocating the pressure tap to various locations in the fan air stream within the housing. Accordingly, the proper selection of a pressure tap location is a time consuming trial and error task which involves excessive engineering and tooling costs depending upon the particular size and location of the furnace with which the induced draft blower is to be used.

Based upon the foregoing, there is a need in the art for an induced draft blower which generates a predictable static pressure value without having to relocate the pressure tap for each different model furnace.

DISCLOSURE OF INVENTION

In light of the foregoing, it is a first aspect of the present invention to provide a blower assembly for generating static pressure.

Another aspect of the present invention is to provide a blower assembly which includes a housing with a blower fan received therein to exhaust combustion by-products from a furnace.

Yet another aspect of the present invention, as set forth above, is to provide a pressure tap in a fixed location on the housing to ensure that the blower fan is operating properly.

Still another aspect of the present invention, as set forth above, is to provide the blower fan with two circular discs interconnected by a plurality of curved vanes, and wherein one of the discs has a plurality of pressure openings to facilitate generation of a predictable static pressure head that indicates that the blower fan is operational.

A further aspect of the present invention, as set forth above, is to vary the number of pressure openings, that is, the total area of the openings depending upon the furnace design, to generate a static pressure value corresponding thereto.

An additional aspect of the present invention, as set forth above, is to provide a pressure switch connected to the pressure tap, wherein the pressure switch turns the furnace off when an insufficient static pressure is monitored by the pressure tap.

The foregoing and other aspects of the invention which shall become apparent as the detailed description proceeds are achieved by a blower assembly for generating static pressure, comprising: a housing; a static pressure tap carried by the housing; a blower fan received within the housing; and means for generating a predictable pressure value monitored by the pressure tap when the blower fan is operational.

Another aspect of the invention which will become apparent herein is obtained by a blower for generating a readable pressure, wherein the blower exhausts gas generated by a furnace, comprising: a housing having a cavity covered by a cover plate, the housing carried by a furnace that generates flue gas, the housing having a blower inlet and an exhaust conduit; a motor carried by the housing, the motor rotating a shaft that is received by the housing, there being a hub clearance between the shaft and the housing; and a blower fan rotated by the shaft and received within the housing for pulling gas through the blower inlet and air in through the hub clearance and expelling the gas and the air through the exhaust conduit, the blower fan having means for generating a readable pressure; and means for measuring the readable pressure within the cavity to ensure that the blower fan is operating.

BRIEF DESCRIPTION OF THE DRAWINGS

For a complete understanding of the objects, techniques and structure of the invention, reference should be made to the following detailed description and the accompanying drawings where.

BEST MODE FOR CARRYING OUT THE INVENTION

Figure 1:
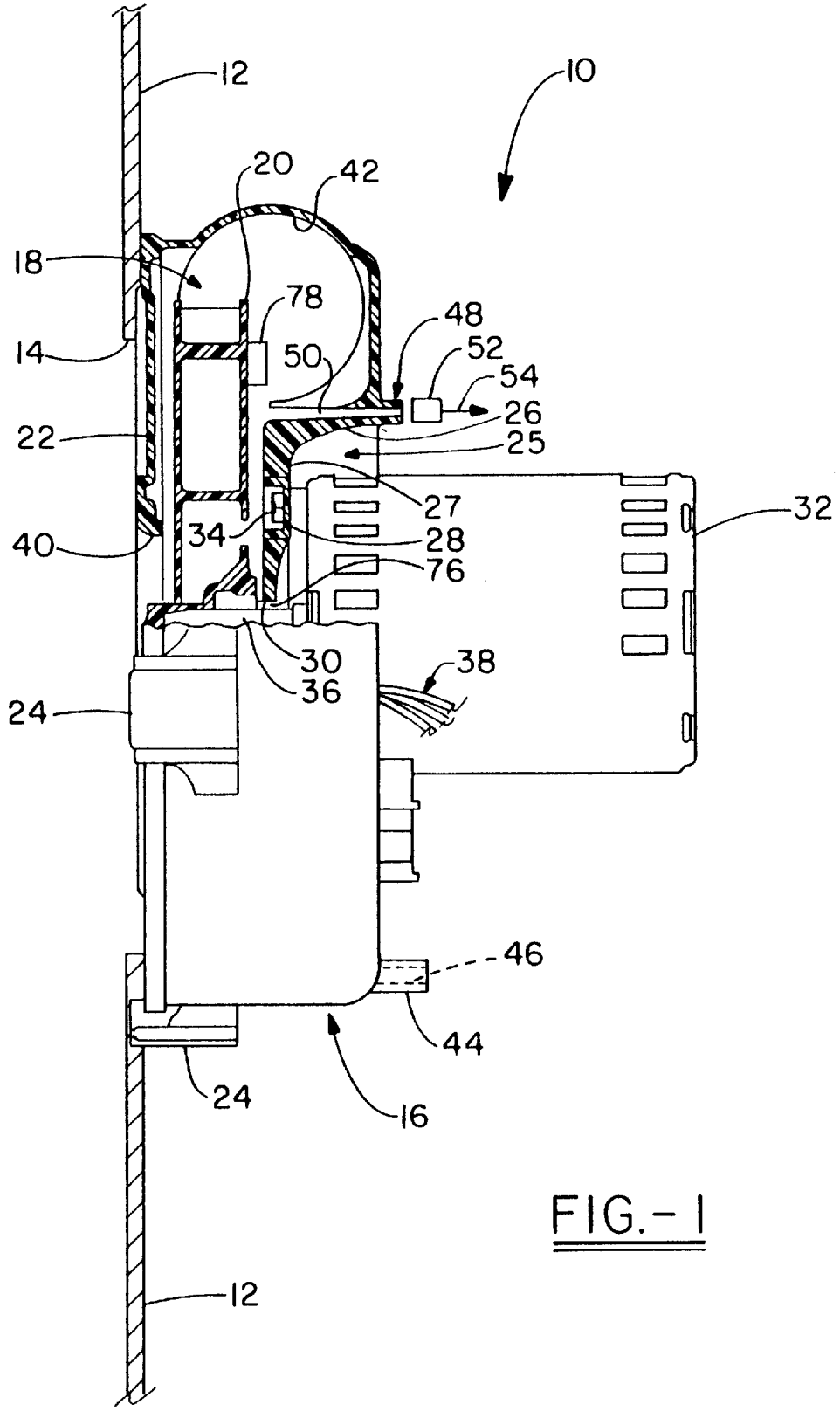
FIG. 1 is a top view, in partial cross-section, of a blower assembly according to the invention.

Referring now to the drawings and more particularly to FIG. 1, it can be seen that a blower assembly for generating static pressure is designated generally by the numeral 10. As shown, the blower assembly 10 is mounted on a furnace panel 12. In particular, the furnace panel 12 has an opening 14 through which the blower assembly 10 pulls combustion by-products or flue gas therethrough and exhausts this gas outside the building receiving the furnace.

The blower assembly includes a housing 16 which has a cavity 18 for receiving a blower fan 20. A cover plate 22 partially encloses the cavity 18 to assist in drawing flue gas through the housing 16. A plurality of lugs 24 extend from the housing 16 for attaching the blower assembly 10 to the furnace panel 12. The housing 16 provides a well 25 which is formed by inwardly extending side walls 26 that are connected to a bottom 27. A plurality of motor mounts 28 extend outwardly from the bottom 27, while in the center portion of the bottom 27 is a hub hole 30.

A motor 32, for rotating the blower fan 20, is secured to the housing 16 and in particular the motor mounts 28 by fasteners 34. Of course, the motor 32 may be mounted to the housing 16 in any manner known in the art. A rotatable shaft 36 extends from the motor 32 and rotates the blower fan 20 in the desired direction. Lead wires 38 extend from the motor 32 and are connected to an electrical power source to energize the motor 32 as dictated by the control parameters of the furnace. Those skilled in the art will appreciate that the motor 32 includes internally mounted cooling fans that draw in external air over the motor coils for cooling the same.

The cover plate 22 provides a blower inlet 40 which is aligned with the furnace panel opening 14. Rotation of the blower fan 20 pulls in flue gas through the opening 14 and the blower inlet 40 and expels the flue gas out an exhaust conduit 42 for expulsion. The exhaust conduit 42 is sized to receive and mate with a standard flue pipe to exhaust the furnace to a chimney or otherwise away from the building receiving the furnace.

A condensation drain 44 may be provided on the outer periphery of the housing 16 to allow for the draining of any flue condensate that collects within the housing 16. A bore 46 extends through the condensation drain 44 to allow for the flow of condensate therethrough. It will be appreciated that the housing 16 may be oriented depending upon the operational requirements of the furnace. As such, a plurality of condensation drains 44 may be provided around the periphery of the housing 16 so that a drain is positioned at the lowest point where condensate collects so that it may be emptied.

A static pressure tap 48 extends from the housing and has a bore 50 which extends therethrough and into the cavity 18. A pressure sensor 52 is positioned over the bore 50 to monitor and read the static pressure within the cavity 18. In the preferred embodiment, the pressure sensor 52 is a diaphragm type pressure sensor, although it will be appreciated that other types of pressure head sensors may be employed. A conduit or electrical conductor 54 is connected to the pressure sensor 52 wherein the other end thereof is connected to a control module. (not shown) The pressure sensor 52 monitors the pressure within the cavity 18 and indicates to the control module whether the blower assembly 10 is functioning properly. It will be appreciated that if the blower assembly 10 is not functioning properly, a build up of combustible by-products or flue gas may collect within the furnace and eventually leak into the building or house which receives the furnace.

Figure 4:
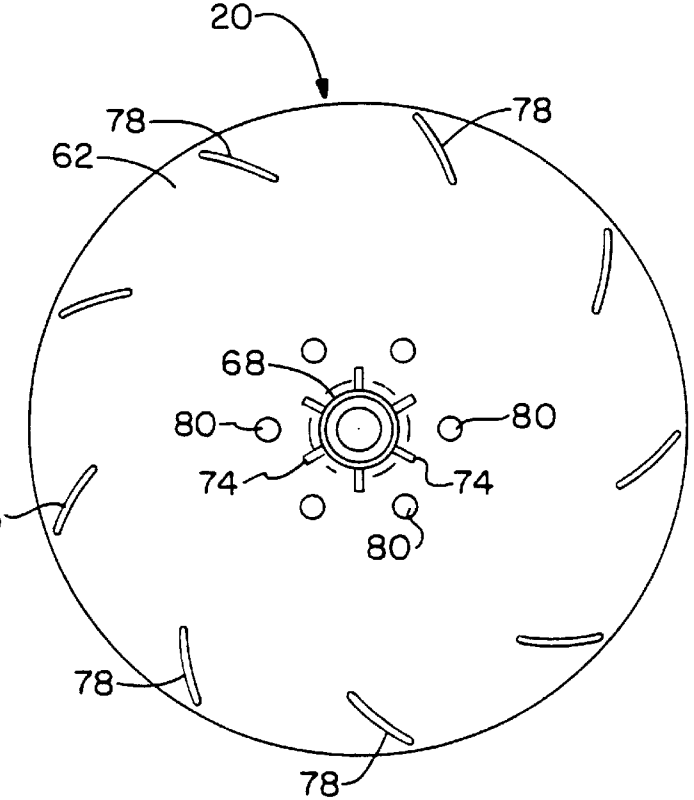
FIG. 4 is a bottom view of the blower fan.
Figure 3:
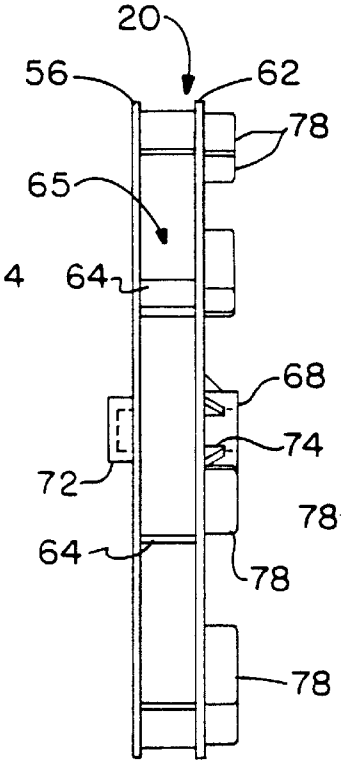
FIG. 3 is a side view of the blower fan.
Figure 2:
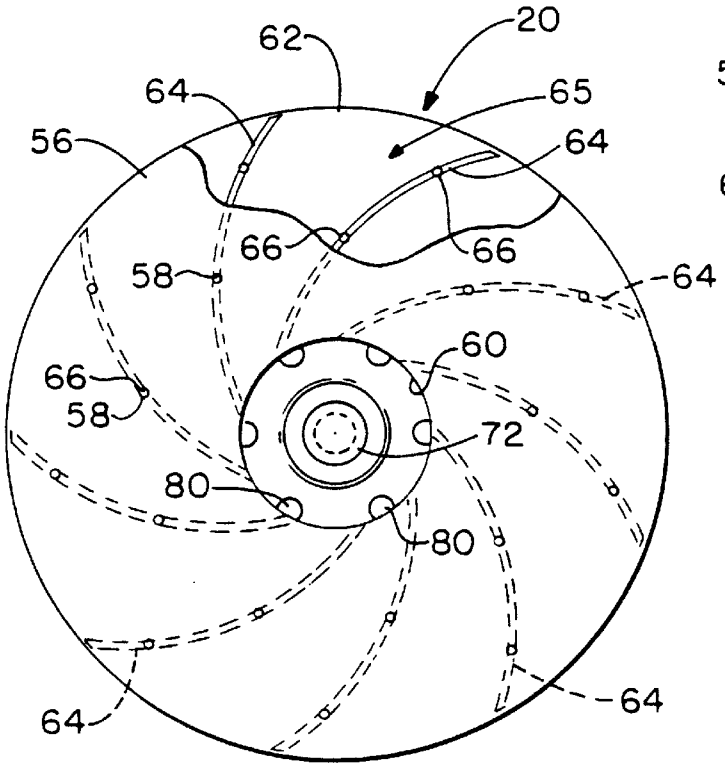
FIG. 2 is a top view of a blower fan used within the blower assembly.

Referring now to FIGS. 1–4 it can be seen that the blower fan 20 includes a fan ring 56 which has a plurality of vane apertures 58 and a centrally positioned fan inlet 60. The blower fan 20 further includes a fan disc or back plate 62 from which extends curvilinear vanes 64. It will be appreciated that the curvilinear vanes 64 are parallel to the axis of rotation and lie within a plane receiving the axis of rotation. These curvilinear vanes 64 form an exhaust port 65 which propels the flue gas from the furnace out the exhaust conduit 42. Each curvilinear vane 64 has a pair of stakes 66 that extend from the edge of the vanes and fit within a respective vane aperture 58 of the fan ring 56. In the preferred embodiment, the blower fan 20 and its components are made of polymeric materials, although selected components may be made of metal. Those skilled in the art will appreciate that the fan ring 56 is connected to the fan disc 62 by ultrasonically welding the stakes 66 into each appropriate vane aperture 58. Of course, other means may be employed to interconnect the fan ring 56 to the fan disc 62. The fan disc 62 further includes a centrally positioned hub collar 68 which receives and engages the motor shaft 36. A hub base 72 extends from the fan disc 62 in the opposite direction of the hub collar 68 and extends into the fan inlet 60 and past the fan ring 56. A plurality of stand-off ribs 74 extend between the hub collar 68 and the fan disc 62. When the blower fan 20 is received in the housing 16, the stand-off ribs 74 fit into the hub hole 30 and bear against the housing 16. As such, a hub clearance 76 is created between the housing 16 and the hub collar 68 to allow for entry of outside air into the blower assembly 10. Extending from the outer periphery of the fan disc 62 are a plurality of back fan blades 78 that increase the static pressure within the cavity 18 and reduces recirculation therein. The inner periphery of the fan disc 62 is also provided with a plurality of pressure openings 80 which are radially arranged around the fan disc 62. Although six pressure openings 80 are shown in FIGS. 2 and 4, it has been found that any number of holes may be used to facilitate the generation of a pressure head within the cavity 18. Further, it has been found that the number of openings 80 is not as critical as is the total area of the openings. The pressure openings 80 are positioned in the interior portion of the fan disc 62 and near the fan inlet 60.

In use, the combusted by-products or flue gas is drawn into the blower assembly 10 through the opening 14, the blower inlet 40 and the fan inlet 60. As the motor 32 rotates the shaft 36 and the blower fan 20, the flue gas is drawn into the fan inlet 60 and redirected by the curvilinear vanes 64 through the fan exhaust ports 65 and out through the exhaust conduit 42. Simultaneously, air from outside the furnace is pulled in through the well 25 and the hub clearance 76 to generate an air draft around the shaft 36. This generates a negative vacuum around the shaft 36 to prevent flue gas from exiting where the shaft enters the housing 16. Additionally, the plurality of pressure openings 80 facilitate the creation of a pressure head monitored by the pressure tap 48.

Figure 5:
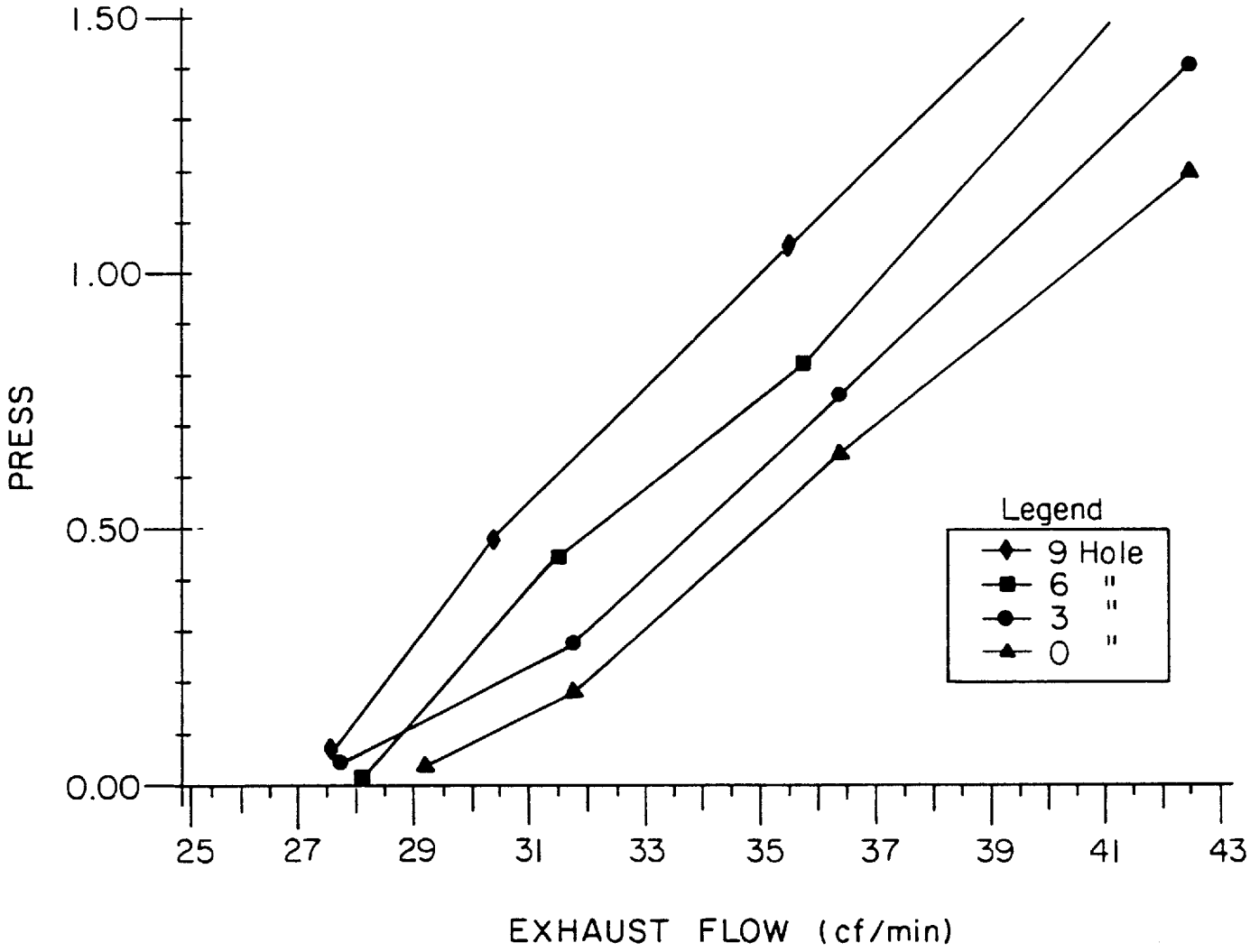
FIG. 5 is a top curve showing the affect of openings in a fan disc.

Referring now to FIG. 5, a plurality of tap curves are presented which represent the flow of air and flue gas through the blower assembly 10. In particular, the graph shows the impact of providing 1, 3, 6 and 9 inch pressure openings 80 in the fan disc 62. Those skilled in the art will appreciate x-axis represents the flow of air in cubic feet per minute and the y-axis represents the pressure monitored by the pressure tap 52 in inches of water. The data points in the lower left hand corner of the graph represent the pressure within the cavity 18 when there is no exhaust restriction and the data points in the upper right hand corner represent the pressure readings when the exhaust conduit 42 is sealed. As can be seen, distinct tap curves are provided for each variation of the blower fan 20 corresponding to the number of pressure openings 80 therein. Accordingly, an original equipment manufacturer of furnaces can readily select a blower fan assembly 10 with a blower fan 20 that generates a static pressure head which engages the pressure sensor 32 within a predetermined range of pressures. As such, designers of the blower assembly 10 are not required to move the location of the static pressure tap 48 to obtain a reading within the cavity 18. This feature is advantageous in that the magnitude of static pressure can be adjusted in a predictable manner without compromising the overall performance of the blower fan assembly. Moreover, by only varying the number of pressure openings 80 instead of the pressure top location, the blower fan assembly can be produced at a reduced cost. This allows the original equipment manufacturer to select an appropriate blower fan assembly for use with a particular furnace.

Thus, it can be seen that the objects of the invention have been satisfied by the structure presented above. It should be apparent to those skilled in the art that the objects of the present invention could be practice with any type of blower fan assembly or the like.

While the preferred embodiment has been presented and described in detail, it will be understood that the invention is not limited thereto or thereby. Accordingly, for an appreciation of the true scope and breadth of the invention, reference should be made to the following claims.

What is claimed is:

1. A blower for generating static pressure, comprising:

a housing;

a static pressure tap carried by said housing;

a blower fan received within said housing, said blower fan having a fan disc, and a fan ring connected to said fan disc by a plurality of vanes, said fan disc having an outer periphery and a centrally positioned hub collar and a plurality of pressure openings through said fan disc between said outer periphery and said hub collar, wherein said plurality of pressure openings generate a predictable pressure value monitored by said pressure tap when said blower fan is operational.

2. The blower according to claim 1, wherein said fan ring has a fan inlet for pulling air into the blower and said plurality of vanes exhausts said air, said plurality of pressure openings generating said predictable pressure value.

3. The blower according to claim 2, wherein said housing further comprises a cover plate having a blower inlet that is aligned with said fan inlet, said cover plate positioned adjacent a furnace panel opening.

4. The blower according to claim 2, wherein said housing has a bore therethrough and said static pressure tap comprises:

a pressure sensor received in said bore; and a conduit connected to said pressure sensor to monitor changes in said pressure value, wherein if said predictable pressure value is not within a predetermined range a furnace connected to the blower is turned off.

5. A blower for generating a readable pressure, wherein the blower exhausts flue gas generated by a furnace, comprising:

a housing having a cavity covered by a cover plate, said housing carried by a furnace that generates flue gas, said housing having a blower inlet and an exhaust conduit;

a motor carried by said housing, said motor rotating a shaft that is received by said housing, there being a hub clearance between said shaft and said housing; and a blower fan rotated by said shaft and received within said housing for pulling flue gas from the furnace through said blower inlet and air in through said hub clearance and expelling the gas and the air through said exhaust conduit, said blower fan having a fan disc with a circular outer periphery and a plurality of pressure openings through said fan disc away from said circular outer periphery, and a fan ring having a fan inlet and a plurality of vanes interconnecting said fan disc to said fan ring, said plurality of pressure openings generating a readable pressure; and means for measuring the readable pressure within said cavity in a fixed location to ensure that said blower fan is operating.

6. The blower according to claim 5, wherein said pan disc has a centrally positioned hub collar, with said plurality of pressure opening between said periphery and said hub collar of said fan disc to generate a predictable static pressure head readable by said measuring means when said blower fan is rotated.

7. The blower according to claim 6, wherein the predictable static pressure head correlates to the number of said plurality of pressure openings.

8. The blower according to claim 7, wherein said measuring means is disposed in a fixed position on said housing and reads a predictable static pressure head regardless of the number of said plurality of pressure openings as long as said blower fan is operating.

9. The blower according to claim 7, wherein said housing has a bore therethrough and said measuring means comprises a pressure sensor received in said bore.

10. The blower according to claim 9, wherein said blower fan has a hub collar that extends outwardly from said fan disc with a plurality of stand-off ribs interconnecting said hub collar and said fan disc, said housing having a hub hole through which said hub collar extends, said plurality of stand-off ribs creating said hub clearance with said plurality of stand-off ribs bearing against said housing at said hub hole.

11. The blower according to claim 10, wherein said fan disc has a plurality of back fans extending therefrom in a direction away from said fan ring.

12. The blower according to claim 11, wherein said back fan increases the readable pressure.

13. The blower according to claim 10, wherein said housing has a condensation drain.

* * * * *